US009003992B2

(12) United States Patent
VanScoyoc

(10) Patent No.: US 9,003,992 B2
(45) Date of Patent: Apr. 14, 2015

(54) ANCHOR REELING

(71) Applicant: Bruce K. VanScoyoc, Evart, MI (US)

(72) Inventor: Bruce K. VanScoyoc, Evart, MI (US)

( * ) Notice: Subject to any disclaimer, the term of this patent is extended or adjusted under 35 U.S.C. 154(b) by 0 days.

(21) Appl. No.: 14/120,773

(22) Filed: Jun. 25, 2014

(65) Prior Publication Data

US 2014/0352596 A1 Dec. 4, 2014

Related U.S. Application Data

(63) Continuation-in-part of application No. 12/321,961, filed on Jan. 27, 2009, now abandoned.

(51) Int. Cl.

| | |
|---|---|
| ***B63B 21/22*** | (2006.01) |
| ***B63B 21/16*** | (2006.01) |
| ***B66D 1/72*** | (2006.01) |
| ***B66D 1/74*** | (2006.01) |
| ***B66D 1/06*** | (2006.01) |

(52) U.S. Cl.

CPC . *B63B 21/16* (2013.01); *B66D 1/72* (2013.01); *B63B 21/22* (2013.01); *B66D 1/7452* (2013.01); *B66D 1/7442* (2013.01); *B66D 1/06* (2013.01)

(58) Field of Classification Search

USPC ..... 114/210; 242/285
IPC ..... A01K 89/0155,89/02; B63B 21/22, B63B 21/16

See application file for complete search history.

(56) References Cited

U.S. PATENT DOCUMENTS

| | | | | |
|---|---|---|---|---|
| 3,331,349 | A * | 7/1967 | Oglesby | 114/210 |
| 3,604,658 | A * | 9/1971 | Nurmse et al. | 242/265 |
| 4,103,844 | A * | 8/1978 | Deinert et al. | 242/372 |
| 4,522,354 | A * | 6/1985 | Sato et al. | 242/299 |
| 4,913,076 | A * | 4/1990 | Norton | 114/210 |
| 5,482,221 | A * | 1/1996 | Peterson et al. | 242/285 |
| 5,520,135 | A * | 5/1996 | Rolland et al. | 114/254 |
| 6,206,311 | B1 * | 3/2001 | Kim et al. | 242/288 |
| 2007/0007377 | A1 * | 1/2007 | Miyazaki et al. | 242/245 |
| 2009/0014573 | A1 * | 1/2009 | Kim et al. | 242/255 |
| 2014/0138469 | A1 * | 5/2014 | Tsai | 242/241 |

* cited by examiner

*Primary Examiner* — Stephen Avila
(74) *Attorney, Agent, or Firm* — Timothy S. Stevens

(57) ABSTRACT

Apparatus for anchor line reeling to raise or lower an anchor using a cranked reel employing a clutch bearing and a drag, which drag is controllably released by reverse rotation of the crank. An additional reel drag is used to prevent reel overturning when the anchor is lowered and hits bottom.

1 Claim, 8 Drawing Sheets

ANCHOR REELING

This application is a continuation-in-part of U.S. patent application Ser. No. 12/321,961 filed Jan. 27, 2009 now abandoned, which claimed priority to U.S. Provisional Patent Application Ser. No. 61/062,617 filed Jan. 28, 2008.

BACKGROUND OF THE INVENTION

The instant invention relates to reeling systems and more specifically to a cranked anchor line reel employing a clutch bearing and a drag, which drag is controllably released by reverse rotation of the crank.

Hand cranked reeling systems employing a clutch bearing and a drag, which drag is controllably released by reverse rotation of the crank are known. For example, the CAPTAIN'S PAK ONE-HAND-CRANK MANUAL SIDERIGGER brand reel from Big Jon Sports, Inc. of Interlochen Michigan allows the retrieval of a cannonball for downrigger fishing by clockwise rotation of its hand crank. The clockwise rotation of its hand crank automatically tightens the drag so that the rotational motion of the hand crank is transferred to the reel through the drag. The cannonball is attached to wire rope which is wound-up on the reel. If the hand crank is released, counter-clockwise rotation of the reel is prevented by the clutch bearing. If the hand crank is rotated in the counter-clockwise direction, the drag is progressively released allowing controlled decent of the cannonball. When the cannonball reaches the desired depth, the hand crank is rotated in the clockwise direction to increase the drag and stop the decent of the cannonball. Surprisingly, anchors have not been raised or lowered using a cranked anchor line reel employing a clutch bearing and a drag, which drag is controllably released by reverse rotation of the crank.

SUMMARY OF THE INVENTION

The instant invention is a new use for a cranked reel employing a clutch bearing and a drag, which drag is controllably released by reverse rotation of the crank. The new use is to raise or lower an anchor using a cranked anchor line reel employing a clutch bearing and a drag, which drag is controllably released by reverse rotation of the crank. More specifically, the instant invention is a new use for apparatus comprising a reel, a shaft, a crank, a clutch bearing, and a drag washer, the reel mounted on a first portion of the shaft, a second portion of the shaft mounted in the clutch bearing so that the shaft will rotate only in one rotational direction, the crank threadably attached to a threaded third portion of the shaft so that when the crank is rotated in the rotational direction permitted by the clutch bearing, the crank threads onto the threaded portion of the shaft thereby compressing a drag washer mounted on the shaft directly or indirectly in contact with the reel and the shaft so that the reel rotates in the rotational direction permitted by the clutch bearing and so that when the crank is rotated in the rotational direction opposite the direction permitted by the clutch bearing, the crank unthreads from the threaded portion of the shaft thereby decompressing the drag washer mounted on the shaft directly or indirectly in contact with the reel and the shaft so that the reel can rotate in the rotational direction opposite that permitted by the clutch bearing, the new use being the raising or lowering of a boat anchor by attaching the boat anchor to one end of an anchor line and winding the other end of the anchor line on the reel.

In a highly preferred embodiment, the instant invention is an apparatus for anchor line reeling comprising a reel, a shaft, a crank, a clutch bearing, and a drag washer, the reel mounted on a first portion of the shaft, a second portion of the shaft mounted in the clutch bearing so that the shaft will rotate only in one rotational direction, the crank threadably attached to a threaded third portion of the shaft so that when the crank is rotated in the rotational direction permitted by the clutch bearing, the crank threads onto the threaded portion of the shaft thereby compressing a drag washer mounted on the shaft directly or indirectly in contact with the reel and the shaft so that the reel rotates in the rotational direction permitted by the clutch bearing and so that when the crank is rotated in the rotational direction opposite the direction permitted by the clutch bearing, the crank unthreads from the threaded portion of the shaft thereby decompressing the drag washer mounted on the shaft directly or indirectly in contact with the reel and the shaft so that the reel can rotate in the rotational direction opposite that permitted by the clutch bearing, the apparatus further comprising a friction disk, a pressure plate, a spring and a spring housing, the friction disk being in contact with the shaft and the pressure plate, the pressure plate being slideably engaged with the reel, the spring housing attached to the reel, the spring positioned in the spring housing so that the spring presses directly or indirectly on the pressure plate against the friction disk so that when the crank is rotated in the rotational direction opposite the direction permitted by the clutch bearing the reel can rotate in the rotational direction opposite that permitted by the clutch bearing with a rotational friction provided in part as a consequence of the friction disk being pressed by the spring against the shaft by the pressure plate.

DETAILED DESCRIPTION

Figure 1:
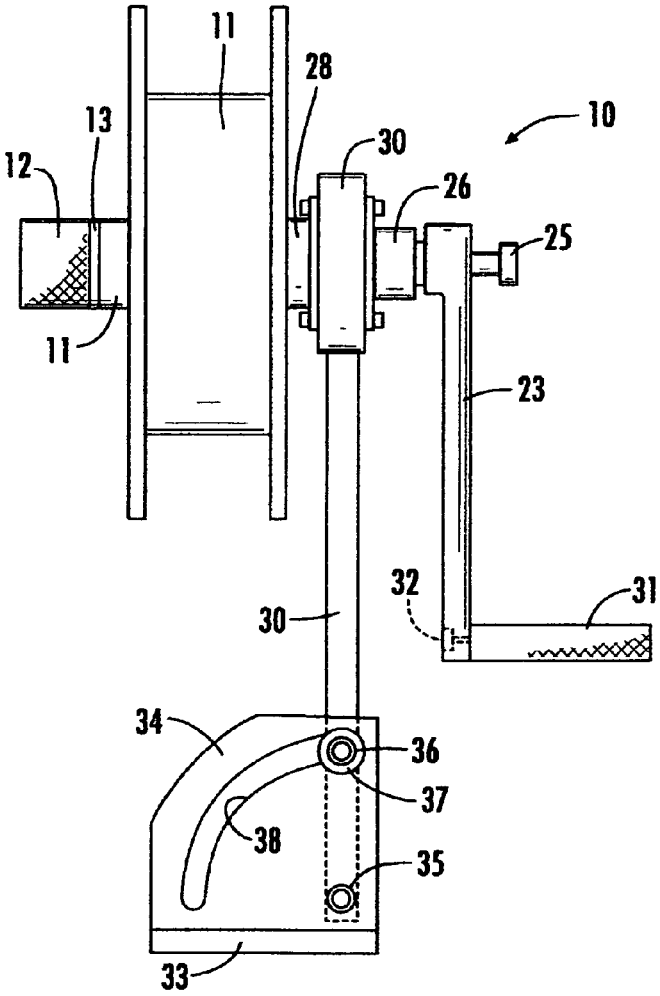
FIG. 1 is a side view of a preferred apparatus for use in the instant invention having a hand cranked reel upon which an anchor line can be wound.

The instant invention is a new use for apparatus comprising a reel, a shaft, a crank, a clutch bearing, and a drag washer, the reel mounted on a first portion of the shaft, a second portion of the shaft mounted in the clutch bearing so that the shaft will rotate only in one rotational direction, the crank threadably attached to a threaded third portion of the shaft so that when the crank is rotated in the rotational direction permitted by the clutch bearing, the crank threads onto the threaded portion of the shaft thereby compressing a drag washer mounted on the shaft directly or indirectly in contact with the reel and the shaft so that the reel rotates in the rotational direction permitted by the clutch bearing and so that when the crank is rotated in the rotational direction opposite the direction permitted by the clutch bearing, the crank unthreads from the threaded portion of the shaft thereby decompressing the drag washer mounted on the shaft directly or indirectly in contact with the reel and the shaft so that the reel can rotate in the rotational direction opposite that permitted by the clutch bearing, the new use being the raising or lowering of a boat anchor by attaching the boat anchor to one end of an anchor line and winding the other end of the anchor line on the reel.

In a highly preferred embodiment, the instant invention is an apparatus for anchor line reeling comprising a reel, a shaft, a crank, a clutch bearing, and a drag washer, the reel mounted on a first portion of the shaft, a second portion of the shaft mounted in the clutch bearing so that the shaft will rotate only in one rotational direction, the crank threadably attached to a threaded third portion of the shaft so that when the crank is rotated in the rotational direction permitted by the clutch bearing, the crank threads onto the threaded portion of the shaft thereby compressing a drag washer mounted on the shaft directly or indirectly in contact with the reel and the shaft so that the reel rotates in the rotational direction permitted by the clutch bearing and so that when the crank is rotated in the rotational direction opposite the direction permitted by the clutch bearing, the crank unthreads from the threaded portion of the shaft thereby decompressing the drag washer mounted on the shaft directly or indirectly in contact with the reel and the shaft so that the reel can rotate in the rotational direction opposite that permitted by the clutch bearing, the apparatus further comprising a friction disk, a pressure plate, a spring and a spring housing, the friction disk being in contact with the shaft and the pressure plate, the pressure plate being slideably engaged with the reel, the spring housing attached to the reel, the spring positioned in the spring plunger housing so that the spring presses directly or indirectly on the pressure plate against the friction disk so that when the when the crank is rotated in the rotational direction opposite the direction permitted by the clutch bearing the reel can rotate in the rotational direction opposite that permitted by the clutch bearing with a rotational friction provided in part as a consequence of the friction disk being pressed by the spring against the shaft by the pressure plate.

Figure 2:
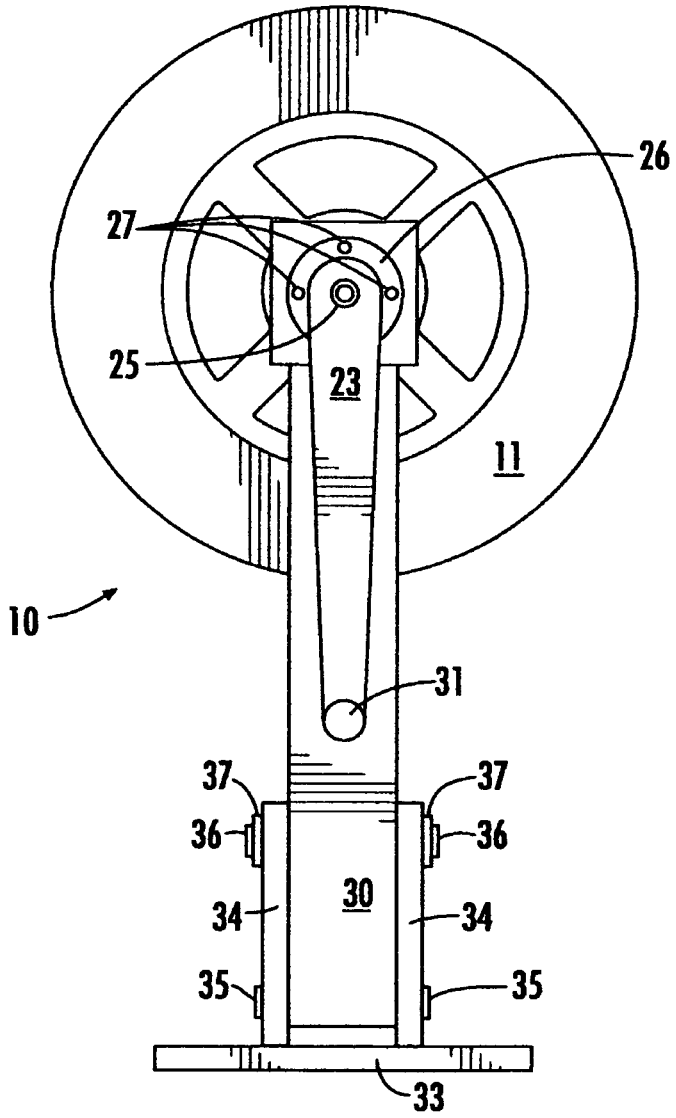
FIG. 2 is a front view of the apparatus shown in FIG. 1.
Figure 3:
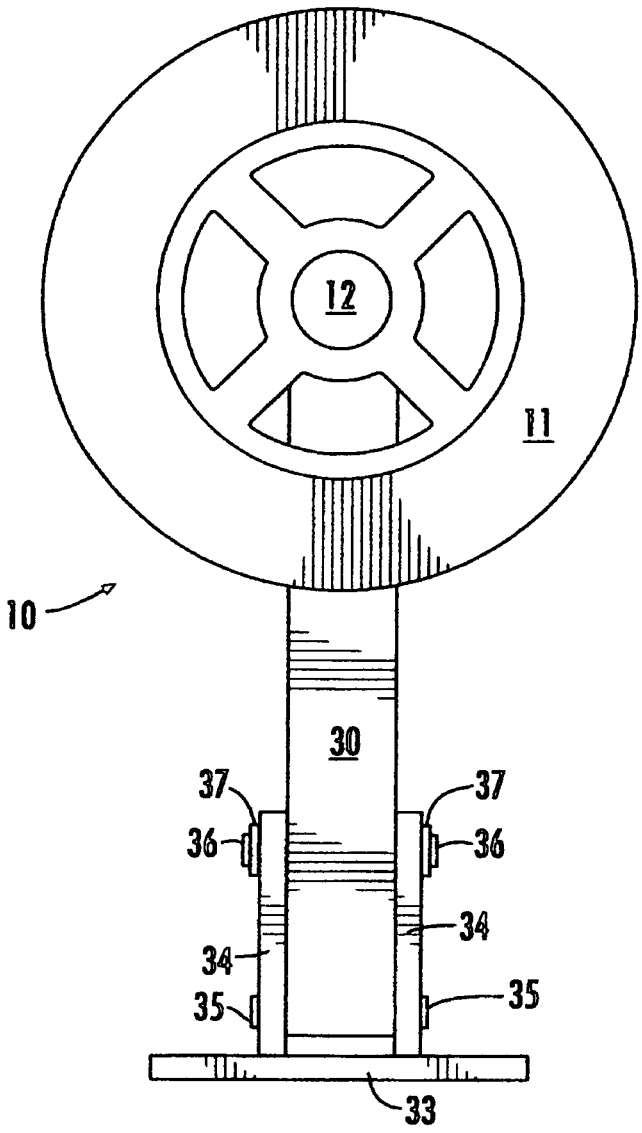
FIG. 3 is a back view of the apparatus shown in FIG. 1.
Figure 4:
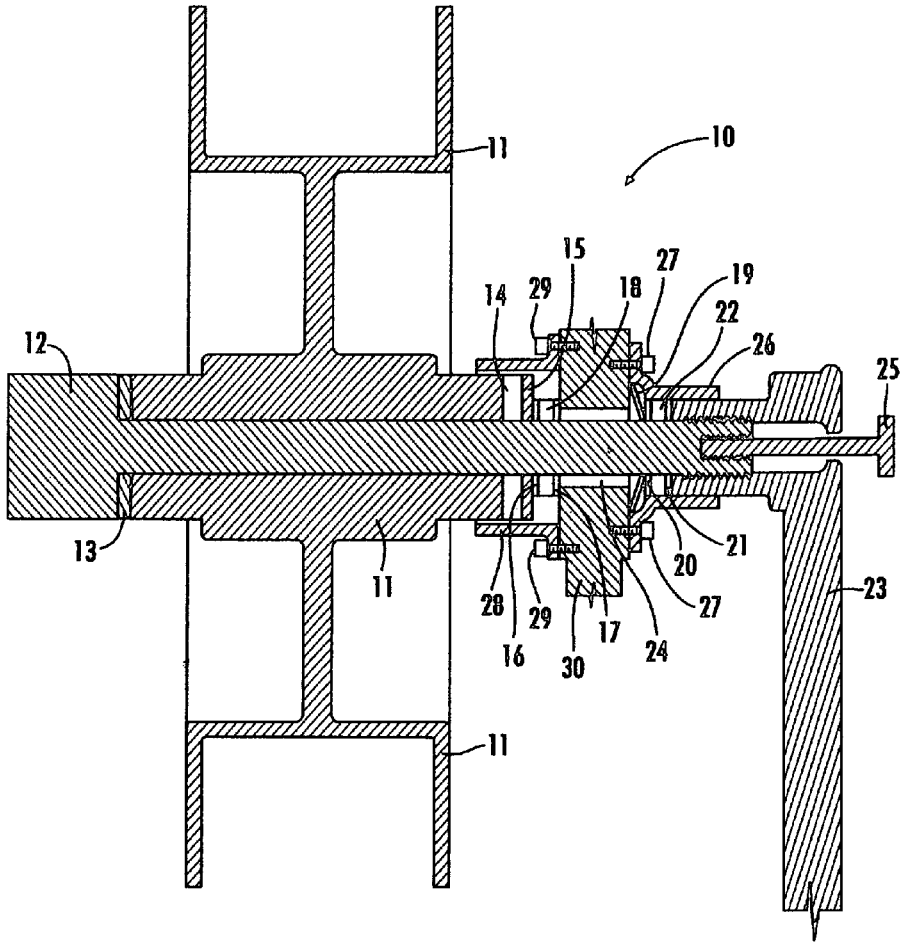
FIG. 4 is an enlarged crosssectional side view of a portion of the apparatus shown in FIG. 1.

Referring now to FIG. 1, therein is shown a side view of a preferred apparatus 10 for use in the instant invention having a hand cranked reel 11 upon which an anchor line can be wound. FIG. 2 is a front view of the apparatus 10 shown in FIG. 1. FIG. 3 is a back view of the apparatus 10 shown in FIG. 1. FIG. 4 is an enlarged crosssectional side view of a portion of the apparatus 10 shown in FIG. 1.

Referring now to FIG. 4, apparatus 10 comprises reel 11, shaft 12, hand crank 23, clutch bearing 27, and drag washers 13 and 14. Clutch bearings are also known as one way bearings or one way clutch bearings. The reel 11 is mounted on a central portion of the shaft 12. Another central portion of the shaft 12 is mounted in the clutch bearing 27 so that the shaft will rotate only in one rotational direction. The hand crank 23 is threadably attached to a threaded third portion of the shaft 12 so that when the hand crank 23 is rotated in the rotational direction permitted by the clutch bearing 27, the hand crank 23 threads onto the threaded portion of the shaft 12 thereby compressing the drag washers 13 and 14 mounted on the shaft directly or indirectly in contact with the reel 11 and the shaft 12 so that the reel 11 rotates in the rotational direction permitted by the clutch bearing 27 and so that when the hand crank 23 is rotated in the rotational direction opposite the direction permitted by the clutch bearing 27, the hand crank 23 unthreads from the threaded portion of the shaft 12 thereby decompressing the drag washers 13 and 14 mounted on the shaft directly or indirectly in contact with the reel 11 and the shaft 12 so that the reel 11 can rotate in the rotational direction opposite that permitted by the clutch bearing 27 thereby facilitating the raising or lowering of a boat anchor by attaching the boat anchor to one end of an anchor line and winding the other end of the anchor line on the reel 11.

Referring still to FIG. 4, other details of the apparatus 10 will be described. Steel washers 15, 16, 17, 20 and 21 are mounted on shaft 12 as shown. A Belleville washer 19 is mounted on shaft 12 as shown. When the crank 23 is rotated in the direction permitted by the clutch bearing 27, the crank 23 presses against the thrust bearing assembly 21, 22, 20, compressing Belleville washer 19, pulling the other end of shaft 12 to compress drag washer 13, drag washer 14, washer 18 and thrust bearing assembly 16, 18 and 17. Thrust bearing 27 is mounted in stanchion 30. An outer sleeve 26 is attached to stanchion 30 by cap screws 27. An inner sleeve 28 is attached to stanchion 30 by cap screws 29. Retaining bolt 25 prevents inadvertent separation of the crank 23 from the shaft 12.

Referring again to FIG. 1, one end of the stanchion 30 is attached to base side 43 by pivot bolt 35. The base side 34 is attached to base bottom 33. The base bottom 33 is configured to be attached to a boat hull. Stanchion 30 can be pivoted to a stowed position by loosening stanchion locking bolt 36 and pivoting the locking bolt 36 in the curved slot 38 in base side 34. Stanchion locking bolt washer 37 is positioned as shown. A crank handle 31 is mounted to one end of crank 23 by crank handle retaining screw 32.

Referring still to FIG. 1, most preferably, the reel 11 is made of cast aluminum, has an outer diameter of about twelve inches, an drum diameter of about seven and one half inches and a width of about three and one half inches. Such a reel can hold over 300 feet of one quarter inch diameter anchor rope.

Figure 5:
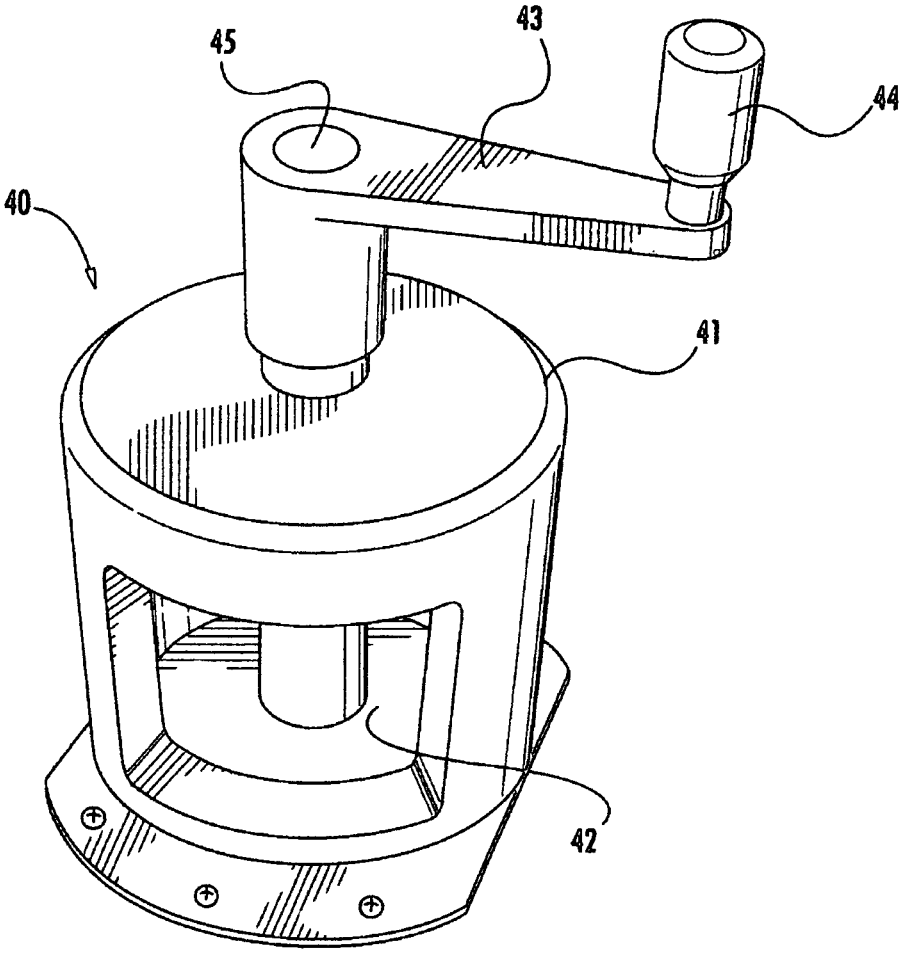
FIG. 5 is a perspective view of a highly preferred apparatus of the instant invention intended for anchor line reeling for a kayak.
Figure 6:
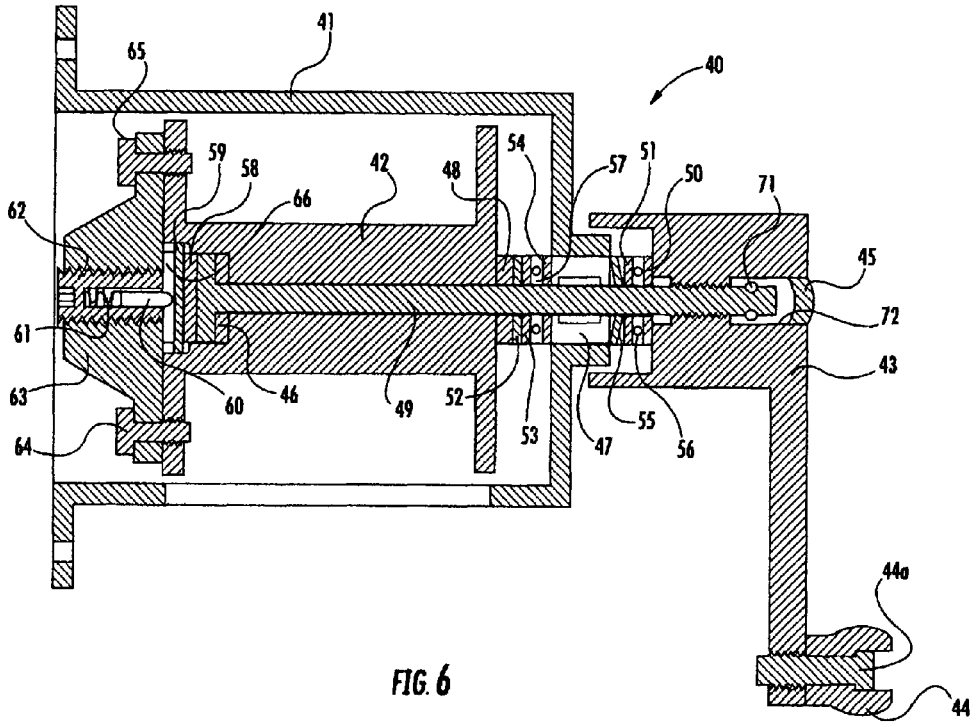
FIG. 6 is a cross-sectional side view of the apparatus shown in FIG. 5.

Referring now to FIG. 5, therein is shown a perspective view of a preferred apparatus 40 of the instant invention intended for anchor line reeling for a kayak. The apparatus 40 is comprises a housing 41, a reel 42, a handle 43, a handle knob 44 and a handle cap 45. Referring now to FIG. 6, therein is shown a cross-sectional side view of the apparatus shown in FIG. 5 including the housing 41, the reel 42, the handle 43, the handle knob 44 and the handle cap 45. Apparatus 40 also comprises clutch bearing 47 mounted in housing 41 and drag washers 46 and 48. The reel 42 is mounted on a central portion of a shaft 49. Another central portion of the shaft 49 is mounted in the clutch bearing 47 so that the shaft will rotate only in one rotational direction. The hand crank 43 is threadably attached to a threaded third portion of the shaft 49 so that when the hand crank 43 is rotated in the rotational direction permitted by the clutch bearing 47, the hand crank 43 threads onto the threaded portion of the shaft 49 thereby compressing drag washers 46 and 48 mounted on the shaft directly or indirectly in contact with the reel 42 and the shaft 49 so that the reel 42 rotates in the rotational direction permitted by the clutch bearing 47 and so that when the hand crank 43 is rotated in the rotational direction opposite the direction permitted by the clutch bearing 47, the hand crank 43 unthreads from the threaded portion of the shaft 49 thereby decompressing the drag washers 46 and 48 mounted on the shaft directly or indirectly in contact with the reel 42 and the shaft 49 so that the reel 42 can rotate in the rotational direction opposite that permitted by the clutch bearing 47 thereby facilitating the raising or lowering of an anchor by attaching the anchor to one end of an anchor line and winding the other end of the anchor line on the reel 42.

Referring still to FIG. 6, other details of the apparatus 40 will be described. Knob 44 is attached to handle 43 by bolt 44*a*. Snap ring prevents unintended complete unwinding of handle 43 from shaft 49. Handle cap 45 covers the bore 72 in the handle 43. Steel washers 50, 51, 52, 53 and 54 are mounted on shaft 49 as shown. A Belleville washer 55 is mounted on shaft 49 as shown. When the crank 43 is rotated in the direction permitted by the clutch bearing 47, the crank 43 presses against thrust bearings 56 and 57, pulling the other end of shaft 49 to compress drag washers 46 and 48. The apparatus 40 further comprises a friction disk 58, a pressure plate 59, a plunger 60 mounted in a hollow screw 62 positioned in a spring housing 63 attached to reel 42 by bolts 64 and 65. Spring 61 indirectly presses against pressure plate 59 by way of plunger 60.

Figure 7:
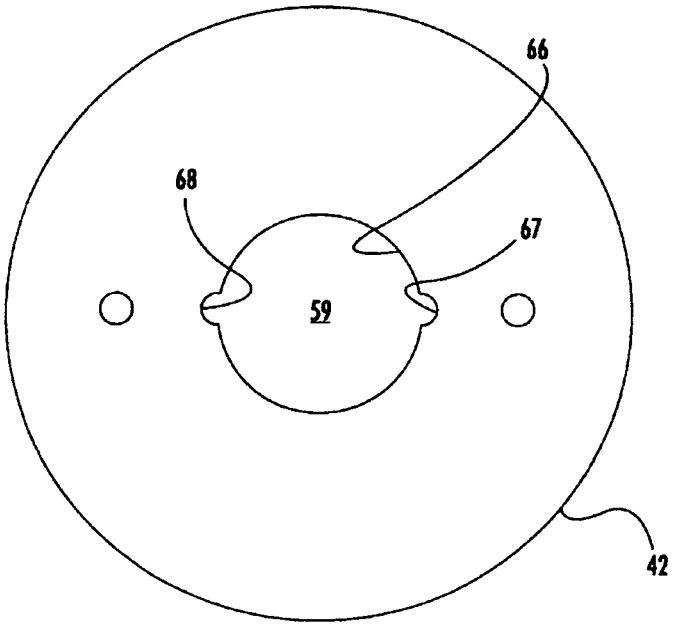
FIG. 7 is an end view of the reel shown in FIG. 6.
Figure 8:
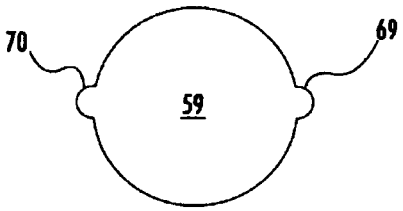
FIG. 8 is a view of the pressure plate of the apparatus shown in FIG. 5.

Referring now to FIG. 7, therein is shown an end view of the reel 42 of the apparatus 40. Pressure plate 59 is shown positioned in recess 66 in the reel 42. Recess 66 is configured with extensions 67 and 68. Referring now to FIG. 8, therein is shown the pressure plate 59. Pressure plate 59 comprises protrusions 69 and 70 dimensioned to correspond to the extensions 67 and 68 of the recess 66 shown in FIG. 7 thereby the pressure plate 59 can slide in the direction of the longitudinal axis of the shaft 49 in the recess 66 and be pressed against the friction disk 58 shown in FIG. 6. Extensions 69 and 70 on pressure plate 59 enable the pressure plate 59 to rotate with the reel 42. The friction disk 58 is in contact with the shaft 49 and the pressure plate 59. The pressure plate 59 is slideably engaged in a recess 66 in the reel 42 and pressed against the friction disk 58 by the spring 60. Spring 61 is positioned in hollow screw 62. The pressure of the plunger against the pressure plate 59 is adjusted by adjusting the screw 62 so that when the when the crank 43 is rotated in the rotational direction opposite the direction permitted by the clutch bearing 47 the reel 42 can rotate in the rotational direction opposite that permitted by the clutch bearing 47 with a rotational friction provided in part as a consequence of the friction disk 58 being pressed by the plunger 60 against the shaft 49 by the pressure plate 59. In use, the hollow screw 62 is adjusted to provide sufficient pressure by the plunger 60 against the pressure plate 59 so that when an anchor is lowered and hits bottom, the reel 42 does not overturn and snarl an anchor line wound on the reel 42.

Figure 9:
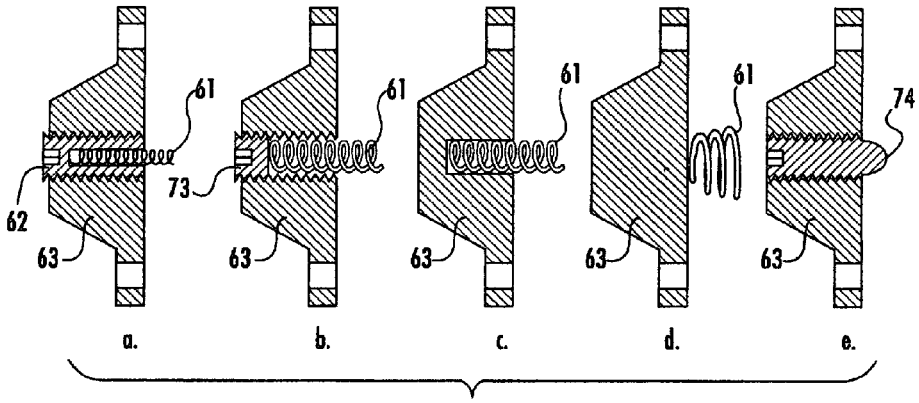
FIGS. 9*a-e* show cross-sectional side views of alternative spring housings.

Referring now to FIG. 9*a*, therein is shown an alternative embodiment for the spring housing 63, hollow screw 62 and spring 61, which alternative embodiment does not incorporate the plunger 60 shown in FIG. 6. In the embodiment shown in FIG. 9*a*, spring 61 presses directly on the pressure plate 59 shown in FIG. 6.

Referring now to FIG. 9*b*, therein is shown an alternative embodiment for the spring housing 63 and spring 61, which alternative embodiment does not incorporate the plunger 60 shown in FIG. 6 and which embodiment employs a set screw 73 behind spring 61 in place of the hollow screw 62. In the embodiment shown in FIG. 9*b*, spring 61 presses directly on the pressure plate 59 shown in FIG. 6.

Referring now to FIG. 9*c*, therein is shown an alternative embodiment for the spring housing 63 and spring 61, which alternative embodiment houses spring 61 in a cavity bored in the spring housing 63. In the embodiment shown in FIG. 9*c*, spring 61 presses directly on the pressure plate 59 shown in FIG. 6. Since the pressure of the spring against the pressure plate is not adjustable in this embodiment, this embodiment is not preferred for many applications.

Referring now to FIG. 9*d*, therein is shown an alternative embodiment for the spring housing 63 and spring 61, wherein spring 61 has a cone shape and the face of the spring housing 63 is flat. In the embodiment shown in FIG. 9*d*, spring 61 presses directly on the pressure plate 59 shown in FIG. 6. Since the pressure of the spring against the pressure plate is not adjustable in this embodiment, this embodiment is not preferred for many applications.

Referring now to FIG. 9*e*, therein is shown an alternative embodiment wherein a screw 74 presses directly on the pressure plate 59 shown in FIG. 6. The spring function of this embodiment is provided by the deflection of the parts as the screw 74 presses on the pressure plate. This alternative embodiment is disclosed to show a broader scope of the invention but this embodiment is not preferred for most applications because the slope of the spring constant provided by the deflection of the parts is much steeper than when a "real" spring is used, such as the spring 61 shown in FIGS. 9*a-d*.

The drag washers and the frictional disk are preferably fiber washers. When a screw is used behind a spring in the spring housing of the instant invention, it is preferable that it be resistant to turning by the use of a thread locking compound such as NYLOK brand thread locking compound. Preferably most of the apparatus of the instant invention is made of steel, stainless steel or aluminum. It should be understood that the combination of a ratchet and a journal bearing is equivalent to a clutch bearing in the instant invention. It should be understood that the term "clutch bearing" in the claims of this application is intended to encompass the combination of a ratchet and a journal bearing. It should be understood that a cone drag as used in better quality fly fishing reels is equivalent to the "drag washer" drag in the instant invention. It should be understood that the term "drag washer" in the claim of this application is intended to encompass the use of such a cone drag. The crank of the instant invention can be a hand crank or a motor driven crank. A preferred motor driven crank comprises a gear motor employing a reversible direct current electric motor. Any suitable anchor line can be used in this invention, including rope made of natural or synthetic fibers and rope or chain made of a metal or a metal alloy. Most preferably, the anchor line is made of a synthetic fiber such as NYLON brand polyester fiber from DuPont.

In use (assuming the anchor is suspended above the water over the side of a boat via its anchor line wound on the reel) the crank is rotated counterclockwise to let out the anchor to the bottom of, for example, a lake or a river. When the desired amount of anchor line has been let out the crank is rotated clockwise to lock the rotation of the reel. If the boat is in a lake, an extra amount of line can be let out to permit the boat to drift downwind over a desired fishing location and then the crank can be rotated to stop rotation of the reel and maintain the position of the boat over the desired fishing location. If the boat is in a river, an extra amount of line can be let out to permit the boat to drift downriver over a desired fishing location and then the crank can be rotated to stop rotation of the reel and maintain the position of the boat over the desired fishing location. The position of the boat can then easily be further adjusted nearer or farther from the anchor by taking in or letting out the anchor line using the disclosed invention. In the embodiment employing a pressure plate and drag disk, overturning of the reel and snarling of the anchor line when the anchor is lowered and hits bottom can be eliminated by adjusting the pressure of the spring against the pressure plate. It should be clearly understood that the embodiment employing a pressure plate and drag disk is applicable to any anchor reel of the instant invention and not just for the kayak reel shown in FIG. 5.

Conclusion

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. Apparatus for anchor line reeling comprising a reel, a shaft, a crank, a clutch bearing, and a drag washer, the reel mounted on a first portion of the shaft, a second portion of the shaft mounted in the clutch bearing so that the shaft will rotate only in one rotational direction, the crank threadably attached to a threaded third portion of the shaft so that when the crank is rotated in the rotational direction permitted by the clutch bearing, the crank threads onto the threaded portion of the shaft thereby compressing a drag washer mounted on the shaft directly or indirectly in contact with the reel and the shaft so that the reel rotates in the rotational direction permitted by the clutch bearing and so that when the crank is rotated in the rotational direction opposite the direction permitted by the clutch bearing, the crank unthreads from the threaded portion of the shaft thereby decompressing the drag washer mounted on the shaft directly or indirectly in contact with the reel and the shaft so that the reel can rotate in the rotational direction opposite that permitted by the clutch bearing, the apparatus further comprising a friction disk, a pressure plate, a spring, and a spring housing, the friction disk being in contact with the shaft and the pressure plate, the pressure plate being slideably engaged with the reel, the spring housing attached to the reel, the spring positioned in the spring housing so that the spring presses directly or indirectly on the pressure plate against the friction disk so that when the crank is rotated in the rotational direction opposite the direction permitted by the clutch bearing the reel can rotate in the rotational direction opposite that permitted by the clutch bearing with a rotational friction provided in part as a consequence of the friction disk being pressed by the spring against the shaft by the pressure plate.

* * * * *